US006377225B1

(12) United States Patent
Silverstein

(10) Patent No.: US 6,377,225 B1
(45) Date of Patent: Apr. 23, 2002

(54) ANTENNA FOR PORTABLE WIRELESS DEVICES

(75) Inventor: Bruce Silverstein, Petach Tikva (IL)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 09/611,534

(22) Filed: Jul. 7, 2000

(51) Int. Cl.[7] ..... H01Q 9/04
(52) U.S. Cl. ..... 343/790; 343/791; 343/792
(58) Field of Search ..... 343/702, 790, 343/791, 792, 725, 700 MS

(56) References Cited

U.S. PATENT DOCUMENTS

| | | | | | |
|---|---|---|---|---|---|
| 2,478,700 | A | * | 8/1949 | Lindenblad | 343/790 |
| 4,369,521 | A | | 1/1983 | Sawada | 455/270 |
| 4,479,130 | A | * | 10/1984 | Snyder | 343/802 |
| 4,734,703 | A | * | 3/1988 | Nasake et al. | 343/790 |
| 5,446,473 | A | * | 8/1995 | Nielsen | 343/890 |
| 6,222,494 | B1 | * | 4/2001 | Erkocevic | 343/790 |

OTHER PUBLICATIONS

"Microwave Engineering", David M. Pozar, Addison–Wesley Publishing Company, Inc., Addison–Wesley Series in Electrical and Computer Engineering, Chapter 3, 1990, pp. 76–100.

* cited by examiner

*Primary Examiner*—Tan Ho
(74) *Attorney, Agent, or Firm*—Ronald O. Neerings; Wade James Brady, III; Frederick J. Telecky, Jr.

(57) ABSTRACT

An enhanced antenna apparatus suitable for use with portable wireless devices. The antenna of the present invention comprises a conductive sleeve having an inner core that can accommodate one or more signal wires passing therethrough. The conductive sleeve functions as the radiating element of the antenna. The length of the conductive sleeve is made an integer multiple of one half the wavelength of the desired frequency. By passing the signal wires through the conductive sleeve the mutual impedance between the antenna itself and signal wires passing through the antenna is eliminated. Alternatively, the antenna can be constructed on a printed circuit board using elongated printed pattern on the top and bottom layers of the printed circuit board. The length of the printed pattern is made an integer multiple of one half wavelength of the desired frequency. One or more signal traces pass under and between the printed antenna patterns on middle layers of the board which functions to eliminate the mutual impedance between the printed antenna and the signal traces.

23 Claims, 3 Drawing Sheets

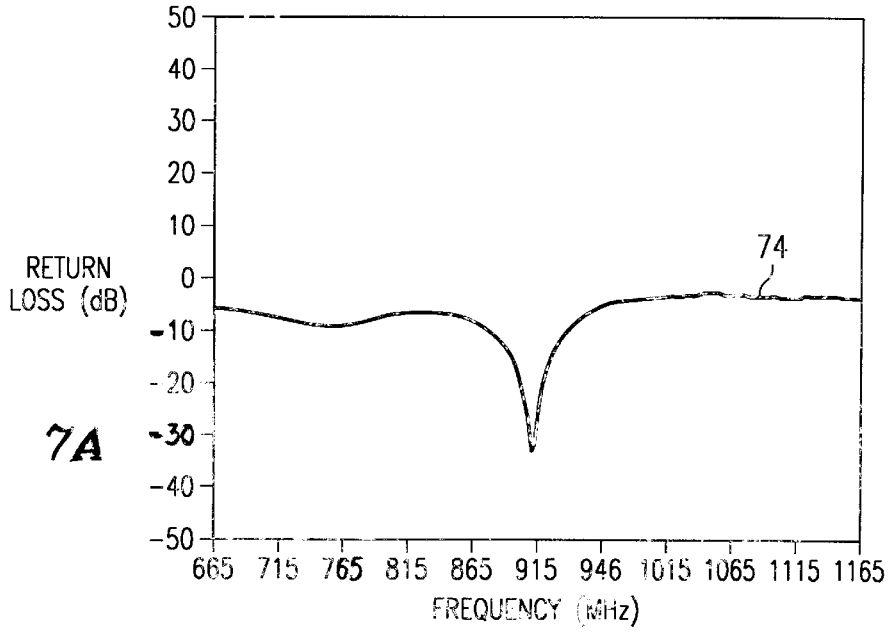
FIG. 7A
FIG. 7B
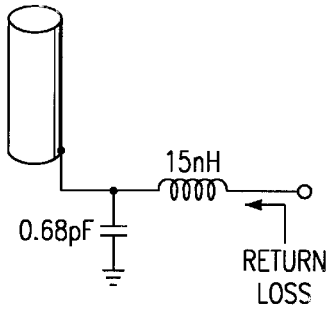
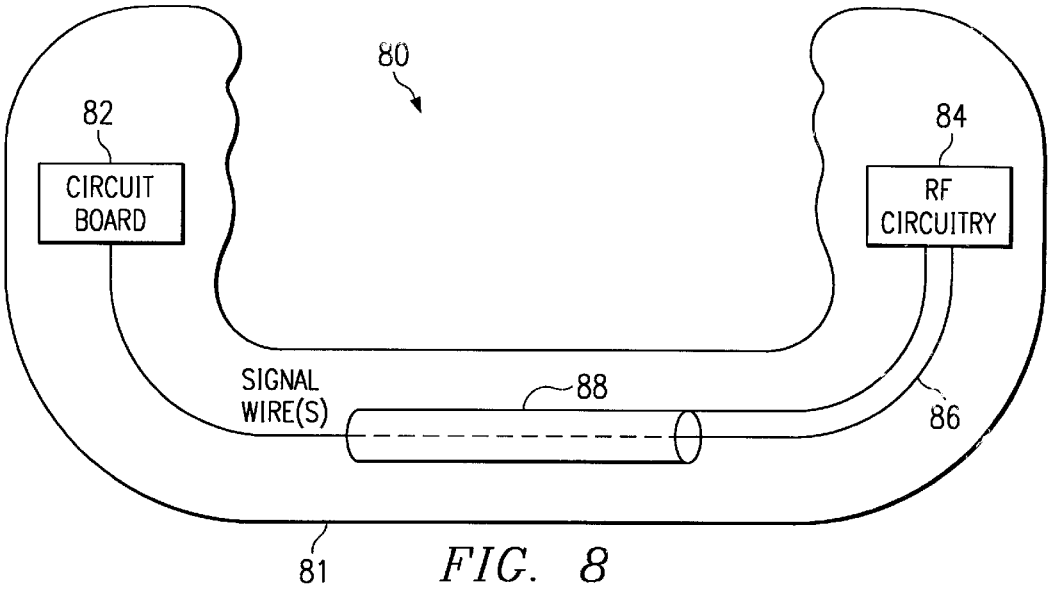
FIG. 8

ANTENNA FOR PORTABLE WIRELESS DEVICES

FIELD OF THE INVENTION

The present invention relates generally to Radio Frequency (RF) circuits and more particularly relates to an enhanced performance antenna suitable for use with portable wireless devices.

BACKGROUND OF THE INVENTION

In many wireless devices today, it is either preferable or required that the antenna be incorporated within the housing of the device. This requirement may be dictated by marketing demands, user demands, etc. In most cases, meeting this requirement means that the antenna is placed in close proximity to one or more signal wires in the device. The signal wires form part of the circuitry in the device and typically are used to interconnect internal modules within the device.

A problem, however, of placing the antenna in close proximity to signal wires is that relatively large passive and active interference is likely to be generated resulting in a degradation of system performance. The level of interference generated depends on a number of factors including, for example, the proximity of the signal wires to the antenna, the actual shape and form of antenna used, the particular frequency band used and the characteristics of the signals carried by the wires.

The passive interference is generated as a result of the mutual coupling between the signal wires and the antenna element. This is equivalent to either the shorting of the antenna or a considerable reduction of its impedance. The active interference is a result of the induced noise generated by the wires and fed into the input of the receiver through the antenna. Another source of active interference is the high levels of RF power generated by the antenna during the time it is used to transmit which may interfere with the circuitry connected to the wires. A common means of combating this problem is to place one or more RF chokes on the wires in order to create RF discontinuities.

A block diagram illustrating an antenna in close proximity to a plurality of signal traces is shown in FIG. 1. The RF circuitry board 10 includes an RF generator 12 coupled to an antenna 14. The signal generation circuitry 16 has a plurality of signal wires 18 that run in close proximity to the antenna 14. The antenna and the signal wires are in close proximity when the distance between them is within approximately ¼ wavelength. For a 1 GHz signal, this corresponds to 7.5 centimeters, assuming the antenna and signal wires are separated by air.

Each of the signal wires has some impedance associated therewith. For example, three wires are shown, one having an inductive impedance 20, capacitive impedance 22 and resistive impedance 24. In addition, the signal wires 18 run substantially parallel with the antenna 14. If the connecting signal wires have relatively low impedance to ground at RF, they will short the antenna thus affecting the radiation pattern of the antenna. Note that this is usually the case since it is common to use decoupling capacitors at the edge of board.

SUMMARY OF THE INVENTION

The present invention overcomes the problems and disadvantages of the prior art by providing an enhanced antenna apparatus suitable for use with portable wireless devices. The antenna of the present invention comprises a conductive sleeve having an inner core that can accommodate one or more signal wires passing therethrough. The conductive sleeve functions as the radiating element of the antenna. Passing the signal wires through the conductive sleeve, eliminates the mutual impedance between the antenna itself and signal wires passing through the antenna. In order for the mutual impedance to be eliminated and the benefits of the invention realized, the length of the conductive sleeve must an integer multiple of one half the wavelength of the desired frequency. Note that typically, an integer multiple of one (i.e. ½ the wavelength) is used.

Example embodiments of the antenna comprise a sleeve antenna and a printed antenna. In practice, the antenna is connected to an RF generator which may comprise either transmitter, receiver or both as the antenna of the present invention may be used for either transmission or reception.

There is thus provided in accordance with the present invention a radio frequency (RF) antenna comprising an electrically conductive sleeve having a length substantially equal to an integer multiple of one half wavelength of the desired frequency, the conductive sleeve adapted to function as a radiating element of the antenna, wherein the conductive sleeve adapted to peripherally surround one or more signal wires inserted into an inner portion of the sleeve such that the signal wires pass completely through the conductive sleeve and wherein the signal wires appear as an open circuit at both ends of the conductive sleeve thus substantially reducing the mutual impedance between the sleeve and the wires as a consequence of the transmission line effect of the one half wavelength length of the sleeve.

There is also provided in accordance with the present invention a radio frequency (RF) antenna comprising a printed circuit board having a top layer, bottom layer and one or more middle layers situated between the top layer and bottom layer, an elongated electrically conductive pattern printed on the top layer and the bottom layer of the printed circuit board, respectively, the pattern having a length substantially equal to an integer multiple of one half wavelength of the desired frequency, the pattern adapted to function as a radiating element of the antenna, wherein the width of the pattern are sufficiently large enough to cover one or more signal traces printed on the middle layers of the printed circuit board such that the signal traces pass in parallel with and through the length of the pattern and wherein the signal traces appear as an open circuit at both ends of the printed pattern thus substantially reducing the mutual impedance between the pattern and the signal traces as a consequence of the transmission line effect of the one half wavelength length of the printed pattern.

There is further provided in accordance with the present invention a wireless device comprising a housing, a first circuit module including a radio frequency (RF) generator, an electrically conductive sleeve having a length substantially equal to an integer multiple of one half wavelength of the desired frequency, the conductive sleeve connected to the RF generator and adapted to function as a radiating element of an antenna, a second circuit module connected to the first circuit module via one or more connecting signal wires, wherein the conductive sleeve is adapted to peripherally surround the one or more connecting signal wires inserted into an inner portion of the sleeve such that the signal wires pass completely through the conductive sleeve and wherein the signal wires appear as an open circuit at both ends of the conductive sleeve thus substantially reducing the mutual all impedance between the sleeve and the wires as a consequence of the transmission line effect of the one half wavelength length of the sleeve.

There is also provided in accordance with the present invention a method of constructing a radio frequency (RF) antenna, comprising the steps of providing an electrically conductive sleeve having a length substantially equal to an integer multiple of one half wavelength of the desired frequency, the conductive sleeve adapted to function as a radiating element of the antenna, shaping the conductive sleeve so as to peripherally surround one or more signal wires inserted into an inner portion of the sleeve such that the signal wires pass completely through the conductive sleeve and wherein the signal wires appear as an open circuit at both ends of the conductive sleeve thus substantially reducing the mutual impedance between the sleeve and the wires as a consequence of the transmission line effect of the one half wavelength length of the sleeve.

BRIEF DESCRIPTION OF THE DRAWINGS

The invention is herein described, by way of example only, with reference to the accompanying drawings, wherein:

FIG. 7A is a plot illustrating the return loss of an example embodiment of the antenna of the present invention;

FIG. 7B is a schematic of the matching elements used during the measurement of the return loss of the example sleeve antenna; and FIG. 8 is a schematic diagram illustrating an example portable wireless device incorporating an example sleeve antenna of the present invention.

DETAILED DESCRIPTION OF THE INVENTION

Figure 1:
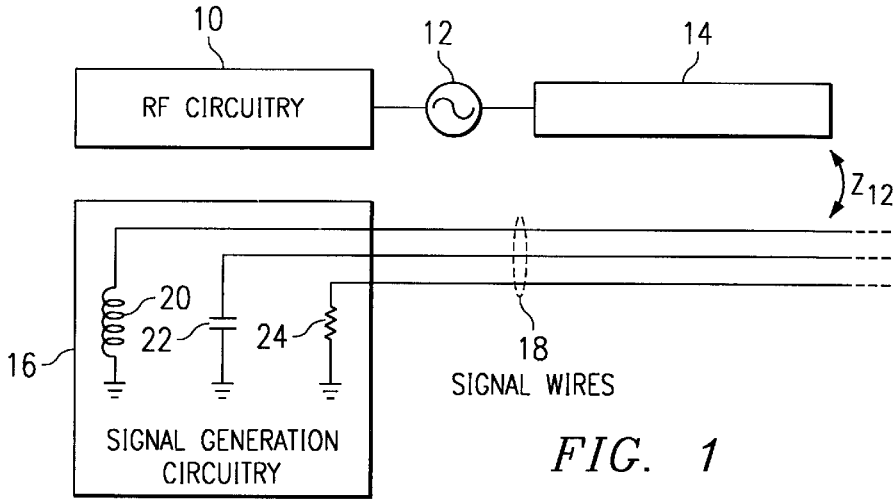
FIG. 1 is a block diagram illustrating an antenna in close proximity to a plurality of signal traces.

The present invention comprises an enhanced antenna apparatus suitable for use with portable wireless devices. The antenna of the present invention comprises a conductive sleeve having an inner core that can accommodate one or more signal wires passing therethrough. The conductive sleeve functions as the radiating element of the antenna. Passing the signal wires through the conductive sleeve, eliminates the mutual impedance between the antenna itself and signal wires passing through the antenna. In order for the mutual impedance to be eliminated and the benefits of the invention realized, the length of the conductive sleeve must be an integer multiple of one half the wavelength of the desired frequency. Note that typically, an integer multiple of one (i.e. ½ the wavelength) is used.

To aid in understanding the principles of the present invention a brief description of classic transmission line theory is presented. Consider a lossless transmission line having an arbitrary load impedance $Z_L$ and an incident wave of the form $V_o^+e^{-j\beta z}$ is generated from a source. From well-known transmission line theory, the ratio of voltage V(z) to current I(z) for such a traveling wave is $Z_o$, known as the characteristic impedance. Since the line is terminated in an arbitrary load $Z_L$ the ratio of voltage to current at the load must be $Z_L$. Therefore, a reflected wave is excited with the appropriate amplitude to satisfy this condition. The total voltage on the line comprises the sum of incident and reflected waves, as shown in Equation 1.

$$V(z)=V_o^+e^{-j\beta z}+V_o^-e^{j\beta z} \tag{1}$$

where $$\beta=\frac{2\pi}{\lambda}.$$

The total current on the line is given by $$I(z)=\frac{V_o^+}{Z_o}e^{-j\beta z}-\frac{V_o^-}{Z_o}e^{j\beta z} \tag{2}$$

The total voltage and current are related by the load impedance, therefore at z=0

$$Z_L=\frac{V(0)}{I(0)}=\frac{V_o^++V_o^-}{V_o^+-V_o^-}Z_o \tag{3}$$

Solving for $V_o^-$ yields $$V_o^-=\frac{Z_L-Z_o}{Z_L+Z_o}V_o^+ \tag{4}$$

The amplitude of the reflected wave normalized to the amplitude of the incident voltage wave is known as the voltage reflection coefficient Γ.

$$\Gamma=\frac{V_o^-}{V_o^+}=\frac{Z_L-Z_o}{Z_L+Z_o} \tag{5}$$

The measure of mismatch of a line is known as the standing wave ratio (SWR) and is defined below as $$SWR=\frac{V_{\max}}{V_{\min}}=\frac{1+|\Gamma|}{1-|\Gamma|} \tag{6}$$

This quantity is also known as the voltage standing wave ratio (VSWR) and is a real number in the range $1 \leqq SWR \leqq \infty$, where SWR=1 implies a matched load.

The reflection coefficient of Equation 5 was defined as the ratio of the reflected to the incident voltage waves amplitude at the load, i.e. l=0. This quantity can be generalized to any point l on the line. Further, the real power flow on the line is a constant but the voltage amplitude, however, is oscillatory with position on the line. The impedance seen looking into the line must, therefore, vary with position. At a distance l=−z from the load, the input impedance seen looking toward the load is $$Z_{in} = \frac{V(-l)}{I(-l)} = \frac{1 + \Gamma e^{-2j\beta l}}{1 - \Gamma e^{-2j\beta l}} Z_o \quad (7)$$

Another form is expressed below $$Z_{in} = Z_o \frac{Z_L + jZ_o \tan\beta l}{Z_o + jZ_L \tan\beta l} \quad (8)$$

This equation provides the input impedance of a length of transmission line having arbitrary load impedance.

Consider a terminated transmission line having a length $l=\lambda/2$ or any integer multiple of $\lambda/2$. Using equation 8 above yields $$Z_{in}=Z_L \quad (9)$$

This result means that a half wavelength line (or any integer multiple of $\lambda/2$) does not alter or transform the load impedance, regardless of the characteristic impedance of the line.

Figure 2:
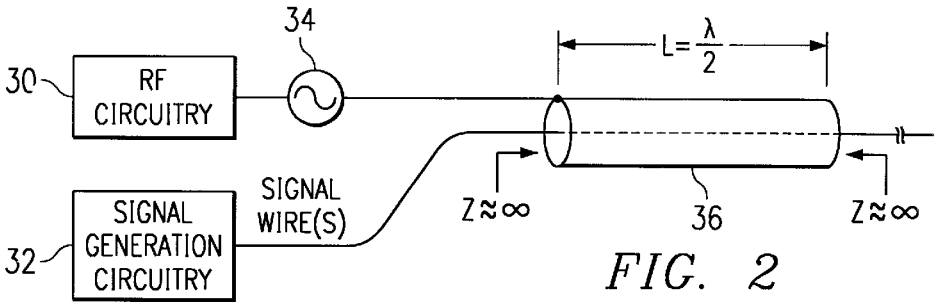
FIG. 2 is a block diagram illustrating a sleeve antenna constructed in accordance with the present invention with one or more signal wires passing though its core.

A block diagram illustrating a sleeve antenna constructed in accordance with the present invention with one or more signal wires passing though its core is shown in FIG. 2. The RF circuitry 30 comprises an RF generator 34 (i.e. with 50 ohm output impedance) coupled via an antenna port to an electrically conductive sleeve 36 that functions as an antenna. Note that the RF generator symbol may represent either a transmitter or a receiver or both. Although, not shown, the ground terminal of the generator is connected to ground potential.

In accordance with the invention, the length of the sleeve is one half wavelength ($\lambda/2$), or an integer multiple thereof. Note that the wavelength of a signal at a particular frequency varies with the dielectric constant of the material it passes through. Thus, the wavelength of a 1 GHz signal is different for transmission through air and through a printed circuit board constructed from fiberglass material.

The sleeve antenna 36 may comprise any suitable hollow electrical conductor such as the shield provided in shield cables. Rather than connecting the shield to ground as is usually done, it is connected at one end to the RF generator 34 (simulating the transmitter's output). One or more signal wires 38, output from signal generation circuitry 32, pass through the inner hollow portion of the sleeve (which may be the shield portion of a shield cable, for example) to emerge at the far end and continue to their point of termination.

In accordance with the present invention, considering the sleeve antenna to have a characteristic impedance $Z_o$, when the length l of the sleeve is $\lambda/2$ (or an integer multiple thereof), the input impedance looking into and out of the sleeve antenna is $Z=\infty$ ohms (around the center frequency). The AC equivalent of this, from the standpoint of the antenna is that there are no interfering wires in proximity of the antenna. Thus, from the perspective of the antenna, the connections to the signal wires are equivalent to an open circuit.

As long as the length of the sleeve antenna is one half wavelength, the coupling impedance between the signal wires and the antenna is infinite and the transmission line effect is operative inside the core of the antenna. Note that there is no coupling, regardless of the type of signal carried over the wires, e.g., high frequency analog or digital signals, DC, ground, etc.

Further, there is no limitation on the number of signal wires that may be passed through the sleeve antenna. The only limitation is the available diameter of the sleeve used for the antenna. In order to achieve no coupling between the antenna and the signal wires, it is a requirement that the signal wires pass through inside of the conductive sleeve or shield. In other words, the sleeve or shield must be the outermost conductor. Any wires that run outside the sleeve will exhibit coupling with the antenna thus disturbing the antenna radiation pattern superposing the antenna signal onto the signal wires. In other words, the wires not only interact with the antenna as passive conductors, thus affecting its radiation pattern, but also interfere actively with it which may result in mutual interference, i.e. an RF signal induced onto those signals, and harmonics and other RFI originating from those signals which could degrade reception sensitivity when the antenna is used for reception.

It is also important that the length of the sleeve be $\lambda/2$ (or an integer multiple thereof). Sleeve lengths other than $\lambda/2$ do not yield maximum decoupling of the antenna and the signal wires. The worst case is when the sleeve length, is $\lambda/4$ (or an integer multiple thereof). In this case, from the standpoint of the antenna, the AC equivalent of the wires is effectively a short at the antenna port and infinite impedance at the end of the antenna.

It is important to note that a key advantage of the sleeve antenna of the present invention is that no decoupling components (i.e. capacitors, inductors, etc) are required in order to eliminate the mutual impedance between the antenna and the signal wires in its proximity. The antenna of the invention is, however, only optimized for a particular frequency. The length of the sleeve must be adjusted in accordance with the desired frequency range in order to achieve the transmission line effect.

Figure 3:
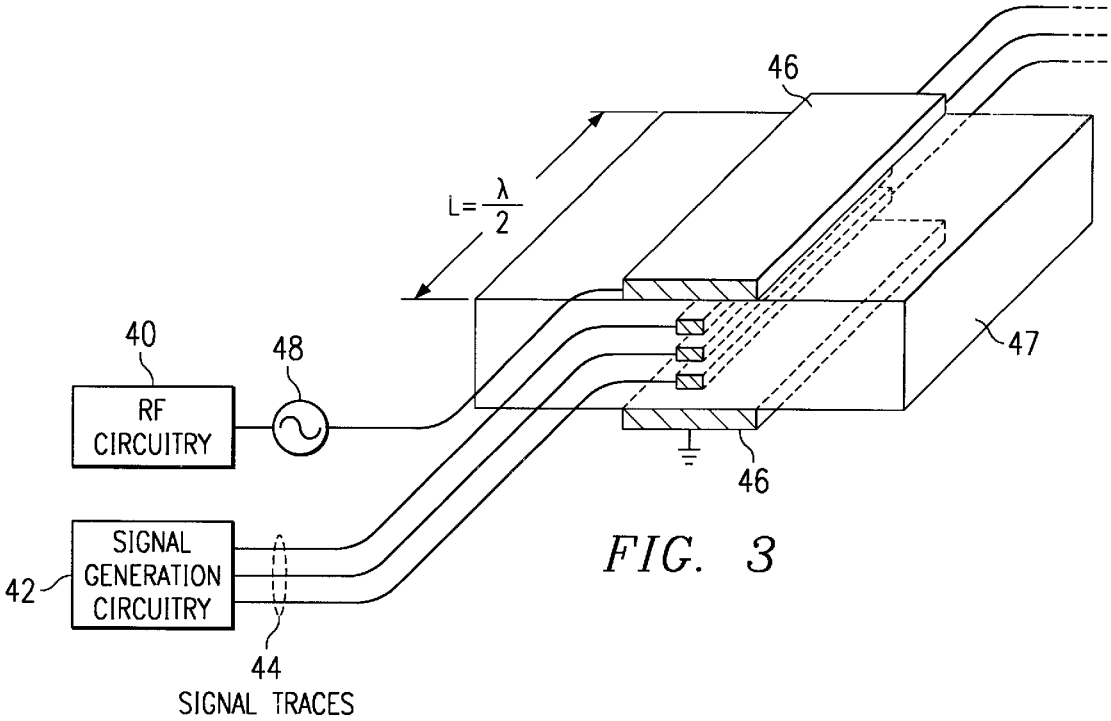
FIG. 3 is a block diagram illustrating the antenna of the present invention implemented as a printed antenna with one or more signal traces running through the antenna.

A block diagram illustrating the antenna of the present invention implemented as a printed antenna with one or more signal traces running through the antenna is shown in FIG. 3. In an alternative embodiment, the antenna is constructed as two elongated printed patterns on a printed circuit board (PCB).

The RF circuitry 40 comprises an RF generator 48 (i.e. a 50 ohm generator) coupled via an antenna port to an electrically conductive pattern 46 printed on a printed circuit board (PCB) 47 having a plurality of layers. The printed circuit board comprises a top, bottom and one or more middle layers located between the top and bottom layers. In accordance with the invention, the conductive pattern is printed on the top and bottom layers of the PCB 47. The printed pattern is adapted to function as the radiating element of an antenna. The length of the printed pattern is one half wavelength ($\lambda/2$), or an integer multiple thereof. Note that the wavelength of a signal at a particular frequency varies with the dielectric constant of the material it passes through. Thus, the wavelength of a 1 GHz signal on a PCB is not the same as in air.

The printed pattern 46 is connected at one end to the RF generator 48. Note that the RF generator represents either a transmitter, a receiver or both and is only meant as a symbol. The ground terminal of the RF generator is connected to the ground potential.

One or more signal traces 44 are adapted to pass in parallel with and between the printed pattern to emerge at the far end. The one or more signal traces are placed on the middle layers of the PC board. Passing the signal traces between the printed pattern 46 substantially reduces the mutual impedance between the printed pattern antenna and the signal wires passing therebetween.

As in the sleeve antenna embodiment described above, the printed pattern antenna is considered to have a characteristic impedance $Z_o$, when the length l of the pattern is $\lambda/2$ (or an integer multiple thereof). In this case, the input impedance looking into and out of the printed antenna is $Z=\infty$ ohms. The AC equivalent of this from the standpoint of the printed antenna is that there are no interfering signal traces in proximity of the printed antenna. Thus, from the perspective of the printed antenna, the signal traces are equivalent to an open circuit.

As long as the length of the printed antenna is one half wavelength, the coupling impedance between the signal traces and the printed antenna is infinite and the transmission line effect is operative inside the core of the printed antenna. Note that there is no coupling regardless of the type of signal carried over the traces, e.g., high frequency analog or digital signals, DC, ground, etc.

In practice, the sleeve antenna is connected to an RF generator which may comprise either a transmitter, receiver or both. In accordance with the invention, the antenna (either the sleeve antenna embodiment or the printed antenna embodiment) may be used for either transmission or reception.

Note that the width of the printed antenna is preferably less than approximately one tenth wavelength. It is a well known rule of thumb in the RF arts that the width of a printed antenna can be neglected and treated like a wire if the width is less than one tenth wavelength.

Figure 4A:
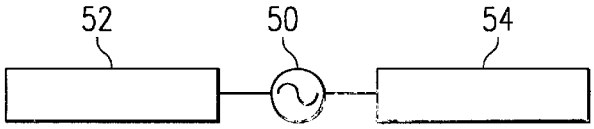
FIG. 4A is a schematic diagram illustrating the antenna of the present invention modeled as a dipole antenna.
Figure 4B:
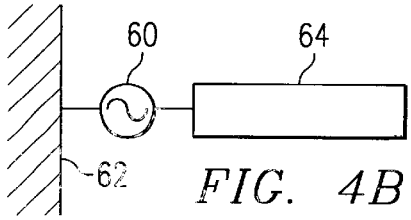
FIG. 4B is a schematic diagram illustrating the antenna of the present invention modeled as a monopole antenna.

A schematic diagram illustrating the antenna of the present invention modeled as a dipole antenna is shown in FIG. 4A. In operation, the grounding provided in the RF circuitry module 30 functions as the counterbalance for the sleeve antenna 36. The antenna can be viewed as a dipole with left and right elements 52, 54 coupled to an RF generator 50. Alternatively, the antenna can be modeled as a monopole antenna as shown in FIG. 4B. In this case the antenna model comprises RF generator 60, ground plane 62 and antenna element 64.

Experiments performed by the inventor demonstrate the effectiveness of the present invention. A sleeve antenna having a length suitable for a center frequency of 915 MHz was constructed. The $\lambda/2$ of the antenna at this frequency is calculated to be approximately length 11.5 centimeters.

$$\frac{\lambda}{2} = \frac{3\times10^8}{2.915\times10^6}\cdot 0.7 \approx 11.5\text{ cm} \tag{10}$$

Figure 5:
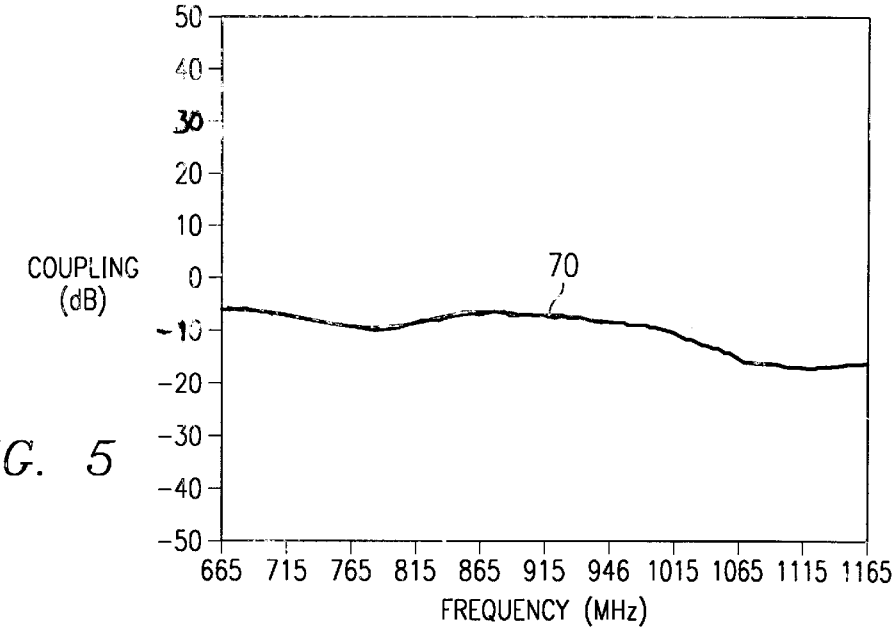
FIG. 5 is a plot illustrating the coupling between an antenna of the prior art and a signal wire in close proximity therewith.

A signal wire was placed in parallel along the length of the antenna at a distance of approximately 2 centimeters from the antenna. Both the antenna and signal wire were connected to ports on a network analyzer through a 50 ohm receiver. The coupling ($S_{21}$) was measured by measuring the RF power received on the signal wire. The results are shown in FIG. 5 wherein the coupling 70 is plotted versus frequency. At the frequency of interest, 915 MHz, the coupling is approximately 6 dB which means that ¼ the power radiated by the antenna is coupled onto the signal wire. This illustrates that there is relatively strong between the sleeve antenna and the signal wire. The proximity of the signal wire severely degrades the radiation from the antenna and superposes the signal radiated onto the signal wire.

Figure 6:
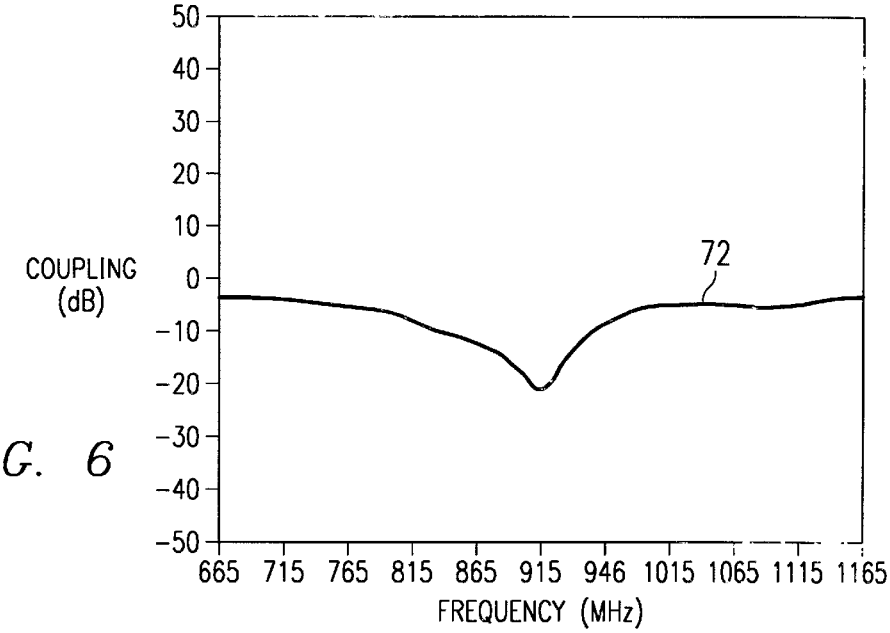
FIG. 6 is a plot illustrating the coupling between an example antenna constructed in accordance with the present invention and a signal wire peripherally surrounded thereby.

A second experiment was performed wherein the signal wire was inserted through the sleeve antenna such that the conductive outer sleeve peripherally surrounded the signal wire in accordance with the invention. The coupling ($S_{21}$) was measured by the network analyzer and the results are shown in FIG. 6. The coupling 72 is plotted versus frequency. At the frequency of interest, 915 MHZ, the coupling is found to be approximately −20 dB which corresponds to a ratio of 100 to 1. This antenna configuration is operative to provide 20 dB of isolation between itself and the signal wire that passes through it. Thus, with the sleeve antenna of the present invention, the coupling is greatly reduced. Note that the further the frequency deviates from 915 MHz, the greater the coupling (i.e. the lower the isolation). This is due to the length of the sleeve becoming less and less ideal as the frequency deviates higher or lower than 915 MHz.

Measurements were taken while the length of the signal wire was varied. The results obtained were not affected by changes in the length of the signal wire, which continued beyond the far ends of the antenna. In addition, as a result of the decoupling achieved between the sleeve and the signal wire, the results were not affected by moving the signal wire around within the proximity of the sleeve in various directions.

To illustrate the effectiveness of the sleeve as an antenna, the amount of radiation that is returned was also measured. This quantity is known as the return loss. Note that the return loss was measured with the sleeve connected to matching elements. These included a 0.68 pF capacitor connected to ground and a series 15 nH inductor as shown in FIG. 7B. The matching elements were used to match the antenna to the generator. Note that these values are meant as an example and may be modified in accordance with different implementations.

The return loss ($S_{22}$) was measured by a network analyzer and the results shown in FIG. 7A. The return loss 74 is plotted versus frequency and is a fairly sharp curve. As can be seen, the return loss is a maximum at 915 MHz where it is equal to approximately 30 dB of loss. At other frequencies, the return loss is much greater. Thus, the sleeve actually performs as a useful antenna.

Note that the above results were obtained for one example embodiment of the invention. One skilled in the art can apply the principles of the present invention to construct decoupled antennas for any desired frequency.

Application of the Sleeve Antenna in a Wireless Device

An example application of the sleeve antenna of the present invention will now be presented. The example application comprises any type of wireless device, typically one that is portable, such as a game controller of the type commonly used with video and computer games. A schematic diagram illustrating an example portable wireless device incorporating the sleeve antenna of the present invention is shown in FIG. 8. The game controller, generally referenced 80, comprises a housing 81, an RF circuitry module 84, a circuit board 82, sleeve antenna 88 and one or more signal wires 86.

The housing 81 is shaped so as to have two elongated handles suitable for grasping during game play. In addition, the game controller comprises one or more switches, buttons, joystick controllers, etc. to be used by players to control game play. Since the game controller is a wireless device, connected to its base by an RF link, no external wires are needed.

Both the circuit board 82 and the RF circuitry module 84 are adapted to fit inside the handles. The RF circuit module 84 is adapted to generate the transmit signal and to receive a signal from the base unit. In accordance with the present invention, an electrically conductive sleeve 88 is connected to the RF circuitry module. The sleeve 88 functions as the radiating element of the antenna.

The circuit board 82 comprises the non-RF circuitry, such as the main controller, logic circuitry, interface circuitry to the buttons, switches, joystick, etc. The two circuit modules are connected via one or more signal wires 86. In accordance with the invention, the signal wires pass through the inner core of the sleeve antenna 88. Preferably, the sleeve antenna 88 is positioned in the space between the two handles since this portion of the game controller is most likely least interfered with by the hands of the user.

The antenna is realized by means of an electrically conductive sleeve that surrounds the wires that pass through it. The conductive sleeve functions as the active element of the antenna. The grounding provided by the RF circuitry module functions as the antenna's counterbalance.

As described above, in accordance with the invention, the length of the conductive sleeve is an integer multiple of ½ the wavelength of the desired frequency. When this condition is met, from an RF point of view, the signal wires appear as an open circuit at both ends of the sleeve. This is in accordance with well known transmission line theory which states that a transmission line section having a length $\lambda/2$ appears as an open circuit.

As described above, the benefits of the sleeve antenna 88 are that the antenna and signal wires can coexist without requiring a minimum distance between them. This requirement may have forced the antenna to be placed in an undesirable location outside the game controller. The antenna matching is not affected by the signals in the wires and impedance matching between the antenna and the RF circuitry module is thus simplified. In addition, the mutual interference between the antenna and the rest of the circuit is reduced, thus improving the effective reception sensitivity. The benefits derived from the sleeve antenna also enable a relatively low cost implementation for the RF and non-RF circuitry and for the mechanical design, including housing, etc.

It is intended that the appended claims cover all such features and advantages of the invention that fall within the spirit and scope of the present invention. As numerous modifications and changes will readily occur to those skilled in the art, it is intended that the invention not be limited to the limited number of embodiments described herein. Accordingly, it will be appreciated that all suitable variations, modifications and equivalents may be resorted to, falling within the spirit and scope of the present invention.

What is claimed is:

1. A radio frequency (RF) antenna, comprising:

an electrically conductive sleeve having a length substantially equal to an integer multiple of one half wavelength of a desired frequency and a signal feed port at one end of said conductive sleeve, said conductive sleeve adapted to function as a radiating element of said antenna;

wherein said conductive sleeve adapted to peripherally surround one or more signal wires inserted into an inner portion of said sleeve such that said signal wires pass completely through said conductive sleeve; and wherein said signal wires appear as an open circuit at both ends of said conductive sleeve thus substantially reducing the mutual impedance between said sleeve and said wires as a consequence of the transmission line effect of the one half wavelength length of said sleeve.

2. The antenna according to claim 1, wherein said sleeve comprises an electrical shield portion of a shielded cable.

3. The antenna according to claim 1, wherein said sleeve is adapted such that a reduction in mutual impedance between said sleeve and said signal wires is substantially independent of the number of signal wires passing through said sleeve.

4. The antenna according to claim 1, wherein said sleeve is adapted such that a reduction in mutual impedance between said sleeve and said signal wires is substantially independent of the position of said one or more signal wires within said sleeve.

5. The antenna according to claim 1, wherein said sleeve is adapted such that a reduction in mutual impedance between said sleeve and said signal wires is substantially independent of the type of signals carried by said one or more signal wires.

6. The antenna according to claim 1, wherein said sleeve is adapted such that a reduction in the effects of mutual impedance between said sleeve and said signal wires is substantially independent of the amplitude of an RF signal input to said sleeve.

7. The antenna according to claim 1, wherein said one or more signal wires carries a DC voltage.

8. The antenna according to claim 1, wherein said one or more signal wires carries an analog signal.

9. The antenna according to claim 1, wherein said one or more signal wires carries a digital signal.

10. The antenna according to claim 1, wherein said one or more signal wires carries ground potential.

11. The antenna according to claim 1, further comprising an RF receiver coupled to said conductive sleeve wherein there is substantially no interference in reception from said one or more signal wires.

12. The antenna according to claim 1, wherein said antenna is connected to a source of RF energy and adapted to function as a transmission antenna.

13. The antenna according to claim 1, wherein said antenna is adapted to function as a receive antenna.

14. A wireless device, comprising:

a housing;

a first circuit module including a radio frequency (RF) generator;

an electrically conductive sleeve having a length substantially equal to an integer multiple of one half wavelength of a desired frequency and a signal feed port at one end of said conductive sleeve, said conductive sleeve connected to said RF generator and adapted to function as a radiating element of an antenna;

a second circuit module connected to said first circuit module via one or more connecting signal wires;

wherein said conductive sleeve is adapted to peripherally surround said one or more connecting signal wires inserted into an inner portion of said sleeve such that said signal wires pass completely through said conductive sleeve; and wherein said signal wires appear as an open circuit at both ends of said conductive sleeve thus substantially reducing the mutual impedance between said sleeve and said wires as a consequence of the transmission line effect of the one half wavelength length of said sleeve.

15. The device according to claim 14, wherein said housing, first circuit module, said conductive sleeve and said second circuit module are components of a game controller.

16. The device according to claim 14, wherein said conductive sleeve is connected to a source of RF energy and adapted to function as a transmission antenna.

17. The device according to claim 14, wherein said conductive sleeve is adapted to function as a receive antenna.

18. A method of constructing a radio frequency (RF) antenna, comprising the steps of:

providing an electrically conductive sleeve having a length substantially equal to an integer multiple of one half wavelength of a desired frequency and a signal feed port at one end of said conductive sleeve, said conductive sleeve adapted to function as a radiating element of said antenna;

shaping said conductive sleeve so as to peripherally surround one or more signal wires inserted into an inner portion of said sleeve such that said signal wires pass completely through said conductive sleeve; and wherein said signal wires appear as a open circuit at both ends of said conductive sleeve thus substantially reducing the mutual impedance between said sleeve and said wires as a consequence of the transmission line effect of the one half wavelength length of said sleeve.

19. The method according to claim 18, wherein said conductive sleeve is connected to a source of RF energy and adapted to function as a transmission antenna.

20. The method according to claim 18, wherein said conductive sleeve is adapted to function as a receive antenna.

21. A radio frequency (RF) antenna, comprising:

an electrically conductive sleeve having a length substantially equal to an integer multiple of one half wavelength of a desired frequency and a signal feed port at one end of said conductive sleeve, said conductive sleeve adapted to function as a radiating element of said antenna; and one or more signal wires inserted into an inner portion of said sleeve such that said signal wires pass completely through said conductive sleeve, said signal wires appearing as an open circuit at both ends of said conductive sleeve.

22. A wireless device, comprising:

a housing;

a first circuit module including a radio frequency (RF) generator;

an electrically conductive sleeve having a length substantially equal to an integer multiple of one half wavelength of a desired frequency and a signal feed port at one end of said conductive sleeve, said conductive sleeve connected at said signal feed port to said RF generator and adapted to function as a radiating element of an antenna;

a second circuit module connected to said first circuit module via one or more connecting signal wires; and one or more connecting sign wires inserted into an inner portion of said sleeve such that said signal wires pass completely through said conductive sleeve, said signal wires appearing as an open circuit at both ends of said conductive sleeve.

23. A method of constructing a radio frequency (RF) antenna, comprising the steps of:

providing an electrically conductive sleeve having a length substantially equal to an integer multiple of one half wavelength of a desired frequency and a signal feed port at one end of said conductive sleeve, said conductive sleeve adapted to function as a radiating element of said antenna; and one or more signal wires inserted into an inner portion of said sleeve such that said signal wires pass completely through said conductive sleeve, said signal wires appearing as a open circuit at both ends of said conductive sleeve.

* * * * *